US012465128B1

(12) United States Patent
Serwaa

(10) Patent No.: US 12,465,128 B1
(45) Date of Patent: Nov. 11, 2025

(54) MULTI PURPOSE TOOL TO DETANGLE GROOM AND STYLE HAIR

(71) Applicant: Yendi Amma Serwaa, Los Angeles, CA (US)

(72) Inventor: Yendi Amma Serwaa, Los Angeles, CA (US)

( * ) Notice: Subject to any disclaimer, the term of this patent is extended or adjusted under 35 U.S.C. 154(b) by 412 days.

(21) Appl. No.: 18/083,446

(22) Filed: Dec. 16, 2022

(51) Int. Cl.
*A45D 24/02* (2006.01)

(52) U.S. Cl.
CPC ..... *A45D 24/02* (2013.01)

(58) Field of Classification Search
CPC ..... A45D 24/00; A45D 24/002; A45D 24/02; A45D 24/06; A45D 2024/005; A45D 24/38; A61H 11/00; A61H 15/0092; A61H 2015/0064
See application file for complete search history.

(56) References Cited

U.S. PATENT DOCUMENTS

| | | | | |
|---|---|---|---|---|
| D783,292 | S * | 4/2017 | Chang | D4/127 |
| 2018/0168310 | A1* | 6/2018 | Xiao | A45D 1/18 |
| 2019/0289992 | A1* | 9/2019 | Thiruppathi | A46B 11/0055 |
| 2021/0345752 | A1* | 11/2021 | Duffy | A45D 24/02 |
| 2022/0378187 | A1* | 12/2022 | York | A46B 9/023 |

FOREIGN PATENT DOCUMENTS

| | | | | |
|---|---|---|---|---|
| CN | 112450576 A | * | 3/2021 | A45D 24/02 |

* cited by examiner

*Primary Examiner* — Rachel R Steitz
*Assistant Examiner* — Karim Asqiriba
(74) *Attorney, Agent, or Firm* — William J. Benman; Benman, Brown & Williams

(57) ABSTRACT

A detangling tool. In the illustrative embodiment, the detangling tool comprises a rigid elongate spine having a longitudinal axis; plural rigid teeth extending from the spine along axes transverse to the longitudinal axis of the spine; and plural ball shape tips on the ends of the teeth, each tip being 3 to 4 times larger in diameter than the tooth upon which it is mounted. In various embodiments, the tool is implemented as a rake, a pick, and a comb. The inventive tool is designed to achieve a separation of hair, configured in locks or otherwise, in directions that are substantially parallel to the scalp. The enlarged ball shape tips effectuate a separation of the locks along axes parallel to the surface of the scalp of the individual being treated. In addition, the large ball shape tips of the tools of the present invention, are designed to maintain a better grip on the hair locked or unlocked as the comb is pulled therethrough in a downward direction through the hair compared to the teeth of conventional combs. That is, instead of merely pushing the hair down or sliding through the hair without much grip, the large, balled tips get under the hair, separate the locks of hair before being pulled downwardly and after the downstroke is initiated, the balls get under the locks and stay in place during the downward motion in a manner not typically observed or associated with conventional tools.

8 Claims, 7 Drawing Sheets

MULTI PURPOSE TOOL TO DETANGLE GROOM AND STYLE HAIR

BACKGROUND OF THE INVENTION

Field of the Invention

The present invention relates to devices for grooming hair. More specifically, the present invention relates to combs for grooming and detangling hair.

Description of the Related Art

Those with long hair are generally well aware of the challenges associated with tangled hair. Inasmuch as millions of men and women around the world have long hair susceptible to being tangled, it is not surprising that many products are on the market for untangling tangled hair. In the main, these products are generally brushes and combs with thin stiff bristles or teeth respectively.

Unfortunately, such conventional detangling and grooming tools have been found to be lacking in efficacy, particularly in the detangling of tightly curled, deeply coiled hence highly textured hair whether it is locked or unlocked. Accordingly, a need has been perceived as persisting in the field for an improved tool, such as a brush or comb, for detangling hair, and grooming small 'locks'.

SUMMARY OF THE INVENTION

The need in the art is addressed by the grooming tools of the present invention. In the illustrative embodiment, the detangling tool comprises a rigid elongate spine having a longitudinal axis; plural rigid teeth extending from the spine along axes transverse to the longitudinal axis of the spine; and plural rounded enlarged ball shaped tips or beads on the teeth, each bead being 3 to 4 times larger in diameter than the tooth upon which it is mounted.

The inventive tool is designed to achieve a separation of hair, configured in locks or unlocked hair, in directions that are substantially parallel to the scalp. The enlarged ball shaped beads effectuate a separation of the locks along axes parallel to the surface of the scalp of the individual being treated. In addition, the enlarged ball-shaped beads are designed to maintain a better grip on the locks of hair as the comb is pulled therethrough in a downward direction through the hair compared to the teeth of conventional combs. That is, instead of merely pushing the hair down or sliding through the hair without much grip, the large beads get under the hair, separate the locks of hair before being pulled downwardly and, after the downstroke is initiated, the rounded tips get under the locks and stay in place during the downward motion in a manner not typically observed or associated with conventional tools. In the illustrative embodiments, the tool is implemented as a comb, a rake, and as a styling pick.

DESCRIPTION OF THE INVENTION

Illustrative embodiments and exemplary applications will now be described with reference to the accompanying drawings to disclose the advantageous teachings of the present invention.

Figure 1:
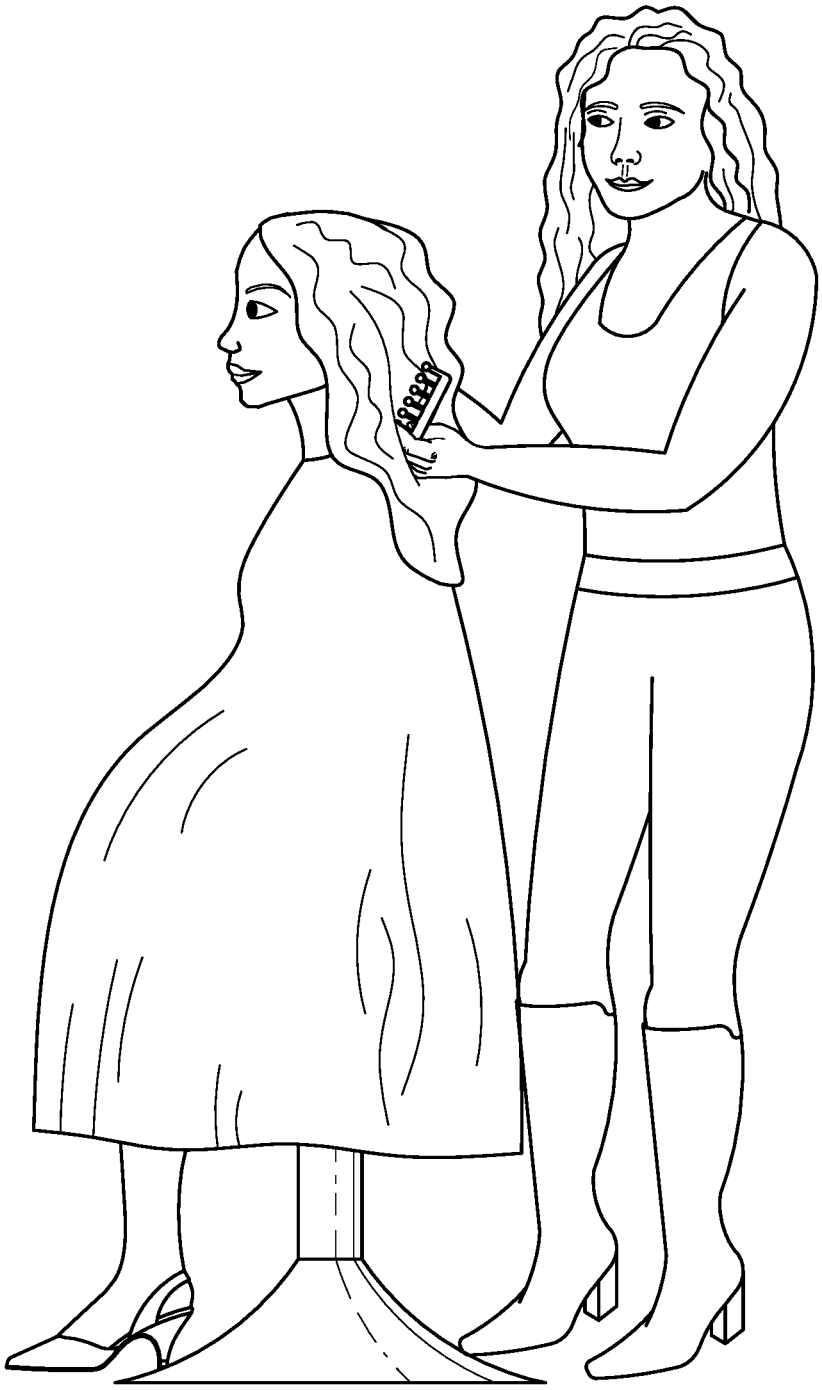
FIG. 1 is an illustration showing use of a tool designed in accordance with the present teachings in use to detangle hair.

FIG. 1 is an illustration showing use of a tool (referred to herein as a 'detangler') designed in accordance with the present teachings to detangle hair. As shown in FIG. 1, in a typical application, a hairdresser performs detangling of loose hair, often following a shampoo while standing behind or next to the customer.

Figure 2:
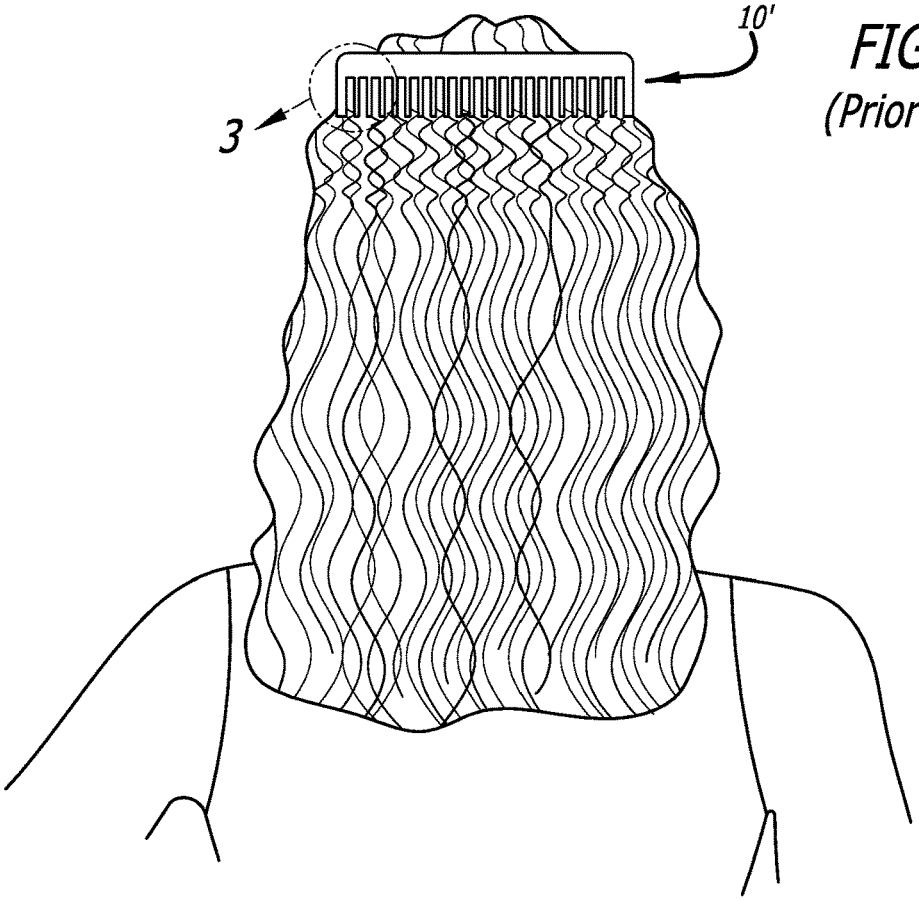
FIG. 2 (Prior Art)
FIG. 2 is a rear view showing a conventional comb being used to detangle hair or locks of an individual.

FIG. 2 is a rear view showing a conventional comb being used to detangle loose hair or to comb the 'locks' of an individual.

Figure 3:
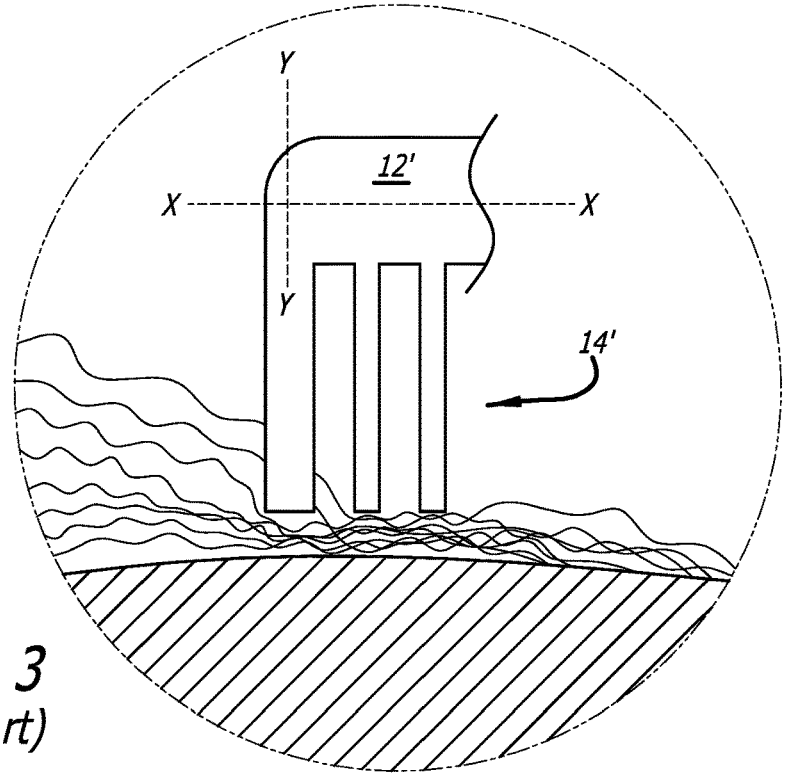
FIG. 3 (Prior Art)
FIG. 3 is a magnified view of the end of the comb depicted in FIG. 2 in the hair or locks of an individual.

FIG. 3 is a magnified view of the end of the comb depicted in FIG. 2 in use in the hair or locks of an individual. As illustrated in FIGS. 2 and 3, a conventional comb has a spine 12' extending along a longitudinal axis x-x and plural teeth 14', extending from the spine 12', along an axis y-y transverse to the spine 12'.

Those of ordinary skill in the art should recognize that a comb 10', such as depicted in FIGS. 2 and 3, of conventional design and construction with substantially linear teeth, will likely see the teeth either penetrate the locks or not. In either case, the locks would not typically be detangled as there is no mechanism to cause them to be separated along the plane of the scalp.

That is, a key feature of the present invention is based on the observation that detangling of hair, particularly 'locks', is substantially facilitated by an mechanism or force that is effective in separating the hair upon insertion and with movement in a direction that is substantially parallel to the scalp. This lateral separation is not typically effectuated effectively by conventional combs. Hence, the present invention has been designed to provide a tool for more effectively separating hair, configured in locks or otherwise, in directions that are substantially parallel to the scalp.

Figure 4:
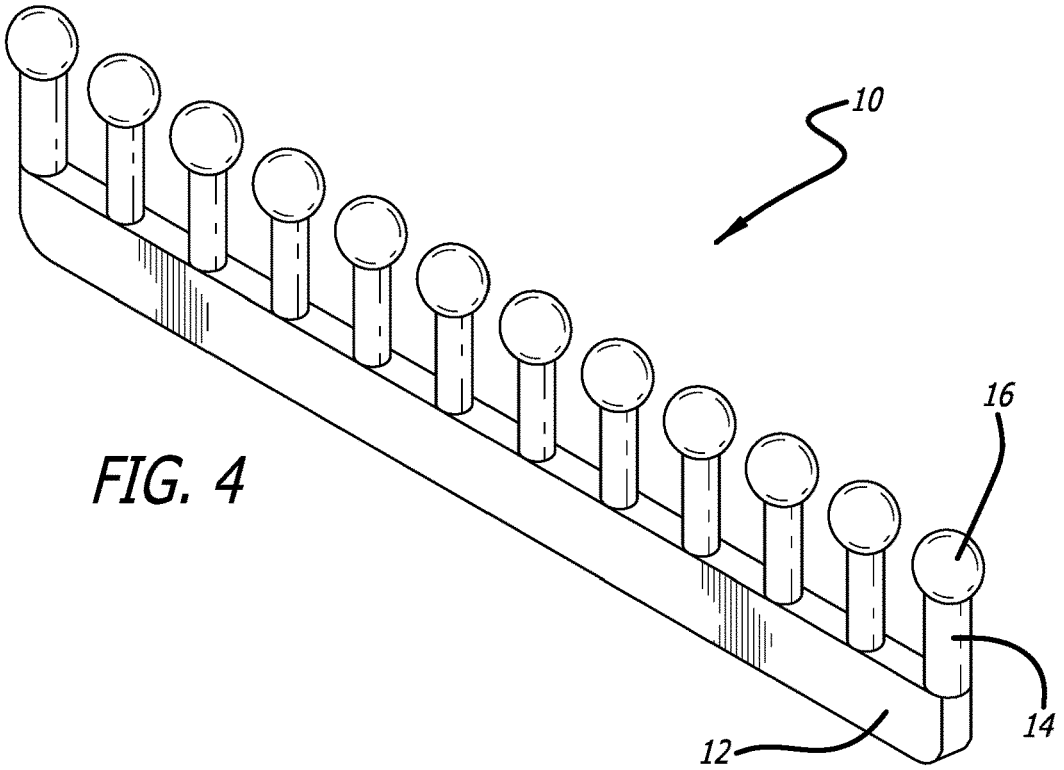
FIG. 4 is a perspective view of a tool implemented in accordance with the present teachings as a simple wide tooth rake styled comb.

FIG. 4 is a perspective view of a tool implemented in accordance with the present teachings as a simple wide tooth rake styled comb.

Figure 5:
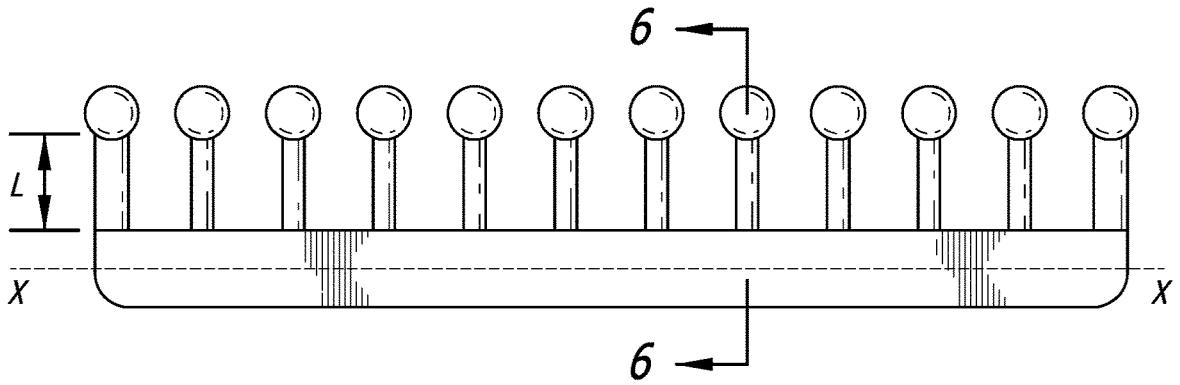
FIG. 5 is a frontal view of the wide tooth comb shown in FIG. 4.

FIG. 5 is a frontal view of the wide tooth rake style comb shown in FIG. 4.

Figure 6:
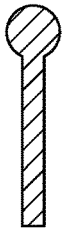
FIG. 6 is a sectional view of a tooth with ball-like finished tip utilized in the styling pick, comb and rake embodiments of the present invention.

FIG. 6 is a sectional view of a tooth with ball tips utilized in the styling pick, comb and rake embodiments of the present invention.

As shown in FIGS. 4-6, the detangling tool 10 of the illustrative embodiment is constructed of plastic, rubber, metal or other suitable material effective to provide a rigid central spine 12 from which plural rigid teeth 14 extend. As shown in FIG. 5, the spine 12 has a longitudinal axis x-x. The teeth 14 extend from the spine 12 along a separate axis y-y (not shown) that, in the illustrative embodiment, is substantially parallel to the spine 12 and transverse to the axis x-x.

In the illustrative embodiment, the teeth are rigid stems, uniform in diameter, 1-1.5 inches in length, 3/16 inches in diameter and spaced 3/8 to 1/2 inches apart. However, it should be understood that the present invention does not require each of the teeth to be of the same length or diameter. Indeed, the teeth can be tapered as discussed more fully below.

As noted above, a key feature of the present invention is the provision of rounded ball shaped tips or beads 16 at the end of one, plural or all of the teeth 14. The beads 16 should be of solid construction. The beads may be constructed from the same material of which the spine and teeth are constructed or may be of a different material construction such as metal. In the best mode, each ball shaped tip (or bead) has a diameter that is at least 3-4 times larger than the diameter of the tooth on which it is mounted. In the illustrative embodiment of FIGS. 4-6, the ball shape tips are 3/8 inches in diameter.

Those skilled in the art will appreciate that the present invention is not limited to the provision of a ball shape tip at the end of each tooth and the ball shape tips may be of different sizes. Nonetheless, in the best mode, a ball shape tip is provided at the end of each tooth and the tips are of uniform sizes.

Figure 7:
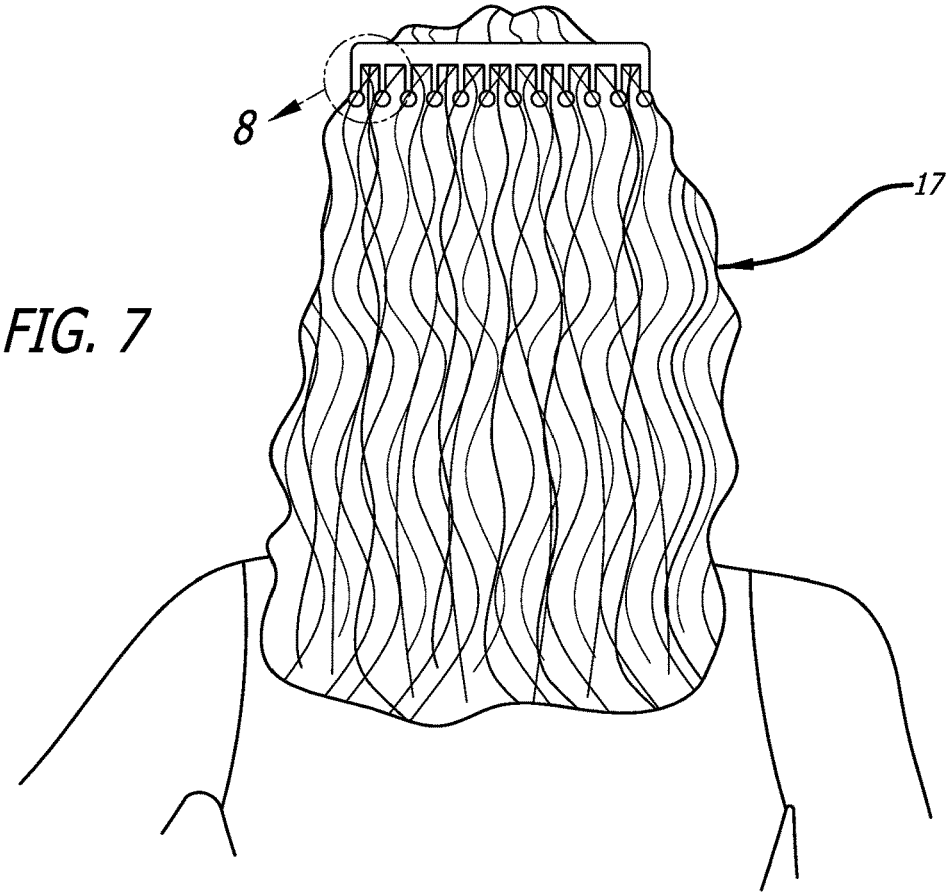
FIG. 7 is a rear view showing an illustrative embodiment of the detangling comb tool of the present invention being used to detangle and groom loose hair or locks of an individual.

FIG. 7 is a rear view showing the illustrative embodiment of the detangling comb of FIGS. 4-6 being used to detangle/comb locks.

Figure 8:
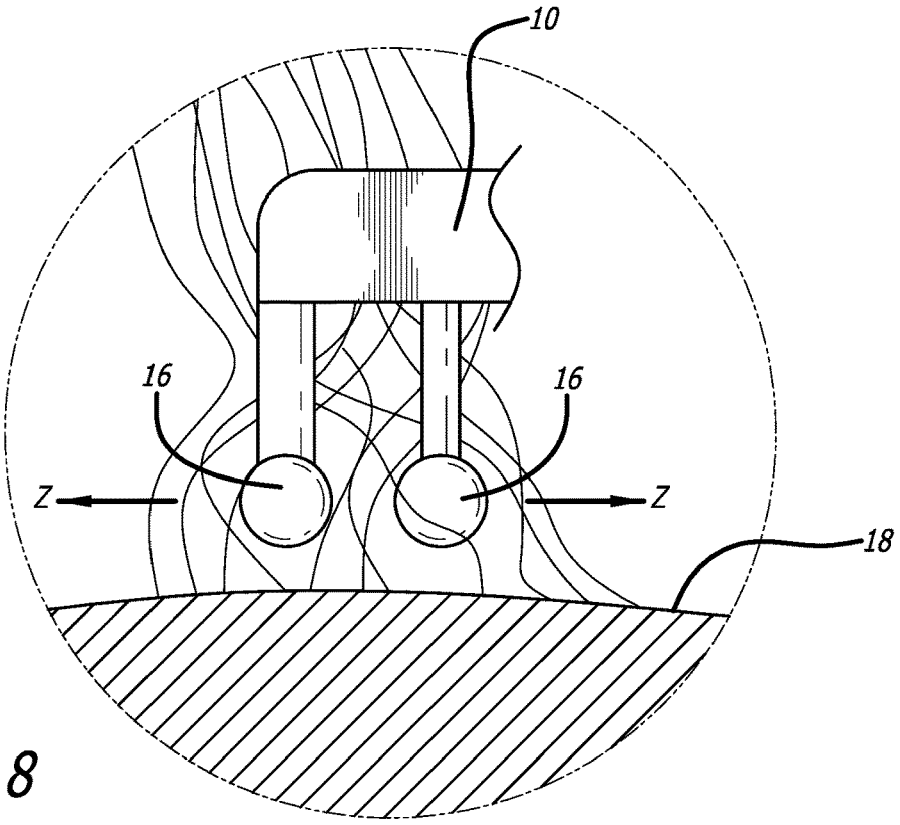
FIG. 8 is a magnified view of the end of the detangling tool of the present invention depicted in FIG. 7 in the hair or locks of an individual.

FIG. 8 is a magnified view of the detangling comb depicted in FIG. 7.

Figure 8A:
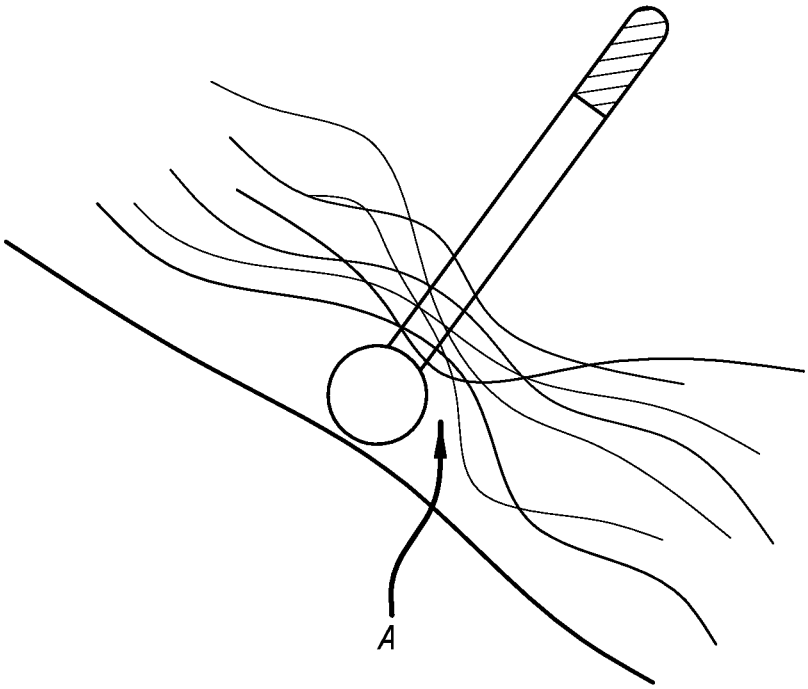
FIG. 8A is a magnified side view of the comb depicted in FIG. 7 in operation.

FIG. 8A is a magnified side view of the comb depicted in FIG. 7 in operation.

FIGS. 7, 8 and 8A illustrate the enhanced efficacy of the tool 10 of the present invention in the illustrative application of detangling loose, locked or unlocked human hair 17. The enlarged ball shape tips 16 effectuate a separation of the locks along axes z-z parallel to the surface of the scalp 18 of the individual being treated. In addition, and simultaneously, the large beads 16 of the comb 10 of the present invention, are designed to maintain a better grip on the locks of hair as the comb is pulled therethrough in a downward direction through the hair compared to the teeth of conventional combs. That is, instead of merely pushing the hair down or sliding through the hair without sufficient grip, the large beads get under the hair and separate the locks of hair before being pulled downwardly. After the downstroke is initiated, the ball-shaped tips get under the locks and stay in place during the downward motion in a manner not typically observed or associated with conventional combs. This feature is illustrated at contact point 'A' in the magnified side view of the comb 10 shown in FIG. 8A.

FIGS. 9-12 show various alternative embodiments of the present teachings.

Figure 9:
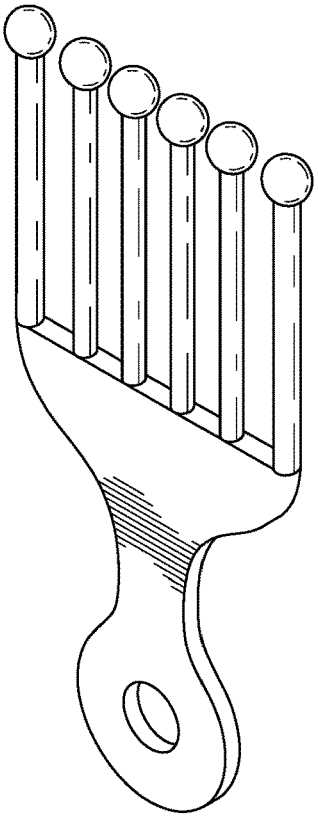
FIG. 9 is a perspective view of a tool implemented in accordance with the present teachings as a styling pick.

FIG. 9, for example, is a perspective view of a tool implemented in accordance with the present teachings as a pick.

Figure 10:
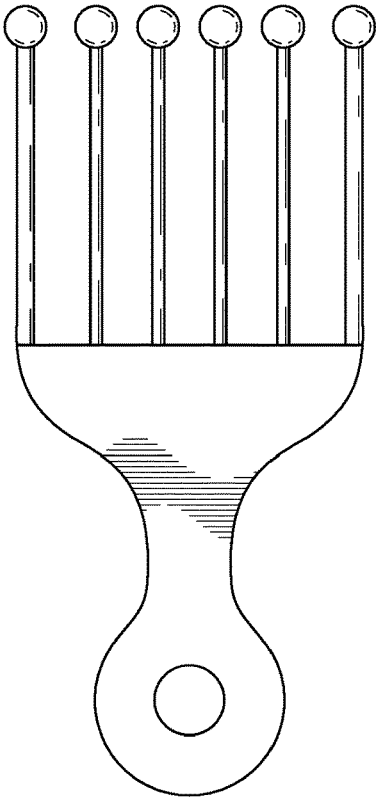
FIG. 10 is a frontal view of the styling pick depicted in FIG. 9.

FIG. 10 is a frontal view of the pick depicted in FIG. 9.

Figure 11:
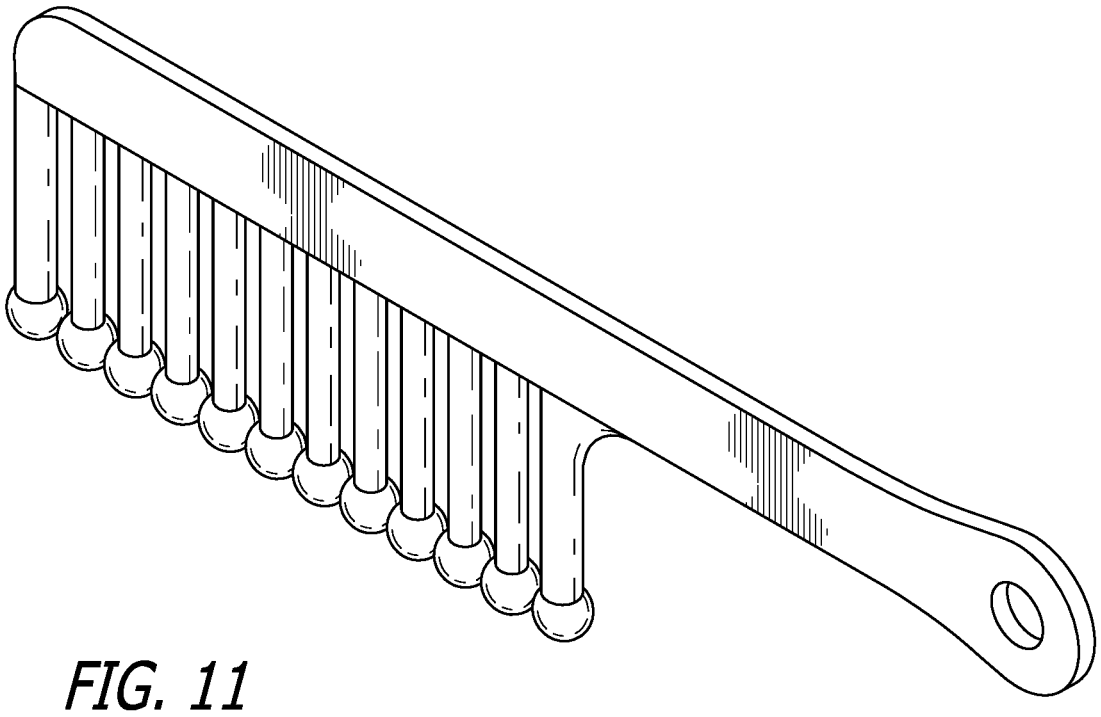
FIG. 11 is a perspective view of a tool implemented in accordance with the present teachings as a wide tooth afro/detangler comb.

FIG. 11 is a perspective view of a tool implemented in accordance with the present teachings as a comb with a handle.

Figure 12:
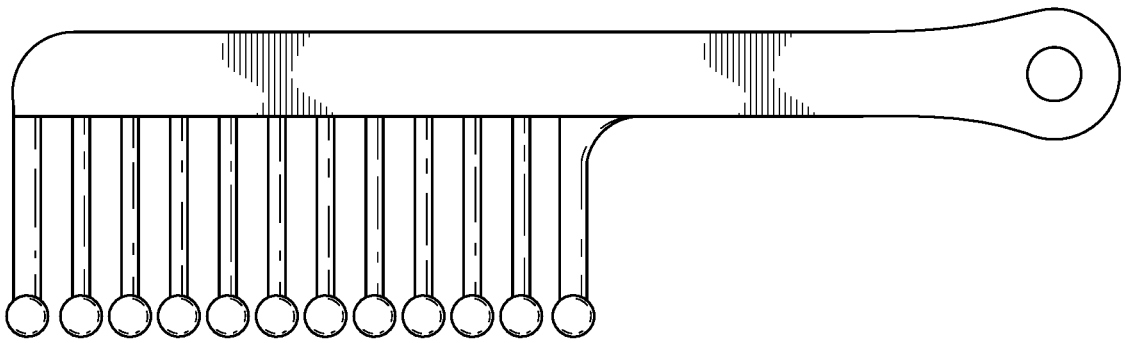
FIG. 12 is a frontal view of the comb shown in FIG. 11.

FIG. 12 is a frontal view of the comb shown in FIG. 11. In the illustrative embodiment of the comb of FIGS. 11 and 12, the handle of the comb is approximately 4.5 inches, however, the invention is not limited thereto. Those of ordinary skill in the art will appreciate that other spacings between the teeth of the comb may be employed without departing from the scope of the present invention.

In conclusion, the invention has been disclosed herein with the following key features:

Purpose: The purpose of the invention is to enable a user to remove tangles from the hair braided into locks without causing discomfort and excessive hair breakage or loss. It should save time with grooming after shampooing and applying conditioner products. Professional hair salons should be able to deliver a more pleasant overall experience to their clients. Parents of small children should have an improved quality of time spent in daily hair grooming of the hair of their children.

Design: The hair de-tangling comb is created in the shape of a hair comb with rounded teeth and tips that are equally spaced and vary in width. As noted above, in the illustrative embodiment, the teeth are 1 to 1.5 inches in length and 1/8 to 3/16 inches in diameter. In one embodiment of the comb, the comb's teeth are round and taper into the beads and the beads range in size from 5/16 to 3/8 inches in diameter. The length of the base of the comb ranges from 3 to 10 inches and from 1/2 to 1 inch from the bottom to the base of the teeth. The comb handles can be rounded and flat with gold-colored stars or other decorative material imprinted thereon. Styling combs could be finished in the same way as the detangler but shaped differently to suit a given application.

Construction: The comb is constructed of very rigid plastic and some versions could be constructed of wood and metal. The construction materials should be selected to withstand heavy long-term use. The combs will be very flexible and able to detangle a wide range of textures of hair. They will be constructed in a variety of sizes to suit the range of user needs. This will also result in reduced damage and discomfort while maximumly detangling the hair. The beads allow the comb to detangle hair with significantly less tearing and resistance as it moves smoothly through the hair at the point of contact. This is due to the shape of the tips of the combs being round as well as the rounded shape of the teeth and the spacing between teeth.

Utility: The primary use of the comb is to detangle hair wet or dry and with or without products such as shampoos, conditioners moisturizers and sprays. The comb can also be used as a styling aid to more easily comb and part the hair. It can also be used to style and groom very small-styled locks.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility. For example, the present teachings may be used to detangle hair of other beings or synthetic materials other than natural hair. Further, as a point of distinction, a 'tip' can be molded or otherwise fabricated along with a molding or fabrication of the tooth and a 'bead' may be secured to a tooth after fabrication of the tooth. Moreover, the bead may be replaced with larger or smaller diameter beads post fabrication of the teeth by the simple addition of threads or other engagement mechanism within the bead and the tooth effective to secure the bead to the tooth. This enables a unique tooth design with beads of diverse diameters mounted on a single comb to suit the needs of a user. That is, large beads may be utilized with small beads or no beads at all in a single unitary comb to detangle hair that may have locks only on a portion or portions of the head and no locks in other areas or sections of locks needing detangling adjacent to other sections of locks for which detangling is not desired. Thus, the bead embodiment of the present invention, with removeable beads, enables multiple bead sizes and therefore multiple modes of operation in a single comb.

It is therefore intended by the appended claims to cover any and all such applications, modifications and embodiments within the scope of the present invention.

The invention claimed is:

1. A detangling tool comprising:

a rigid elongate spine having a longitudinal axis;

plural rigid teeth extending from the spine along axes transverse to the longitudinal axis of the spine; and plural ball shaped tips or beads on ends of the plural rigid teeth, at least one tip or bead being removeable and replaceable, wherein said at least one removeable and replaceable tip or bead and has a threaded interior adapted to engage a thread at an end of at least one tooth or an interior ring adapted to snap onto a small ball on an end of at least one tooth.

2. The detangling tool of claim 1, wherein the tool is a comb.

3. The detangling tool of claim 2, wherein the tool is a rake style comb.

4. The detangling tool of claim 1, wherein the tool is a styling pick.

5. The detangling tool of claim 1, wherein at least one tooth has a bead with a different diameter relative to diameters of at least one bead on one other tooth.

6. A detangling tool comprising:

a rigid elongate spine having a longitudinal axis;

plural rigid teeth extending from the spine along axes transverse to the longitudinal axis of the spine; and plural ball shaped beads on ends of the plural rigid teeth, at least one bead being removeable and replaceable, wherein said at least one removeable and replaceable bead has a threaded interior adapted to engage a thread at an end of at least one tooth.

7. The detangling tool of claim 6, wherein at least a first bead is removable and replaceable on a tooth with a second bead wherein the second bead has a different diameter relative to a diameter of the first bead.

8. A detangling tool comprising:

a rigid elongate spine having a longitudinal axis;

plural rigid teeth extending from the spine along axes transverse to the longitudinal axis of the spine; and plural ball shaped beads on ends of the plural rigid teeth, at least one bead being removeable and replaceable, wherein said at least one removeable and replaceable bead has an interior ring adapted to snap onto a small ball on an end of at least one tooth.

* * * * *